US007210955B2

(12) United States Patent
Ringler et al.

(10) Patent No.: US 7,210,955 B2
(45) Date of Patent: May 1, 2007

(54) FULLY BUFFERED PRESS-FIT DIMM CONNECTOR

(75) Inventors: Daniel R Ringler, Elizabethville, PA (US); Michael A Correll, Hershey, PA (US); Richard N Whyne, Camp Hill, PA (US); Richard E Hamner, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/194,190

(22) Filed: Aug. 1, 2005

(65) Prior Publication Data

US 2007/0026722 A1 Feb. 1, 2007

(51) Int. Cl.
*H01R 13/64* (2006.01)

(52) U.S. Cl. ..... 439/381; 439/637

(58) Field of Classification Search ..... 439/260, 439/381, 637

See application file for complete search history.

(56) References Cited

U.S. PATENT DOCUMENTS 4,586,254 A * 5/1986 Ammon et al. ..... 29/884
5,162,002 A 11/1992 Regnier
5,395,250 A * 3/1995 Englert et al. ..... 439/65
5,462,456 A 10/1995 Howell
5,554,047 A * 9/1996 Englert, Jr. ..... 439/405
5,620,342 A 4/1997 Kinross
5,785,556 A 7/1998 Pratt et al.
6,309,254 B1 10/2001 Korsunsky
6,419,503 B1 7/2002 Choy
6,431,889 B1 * 8/2002 Olson ..... 439/157
6,517,378 B2 2/2003 Fumikura
6,540,540 B1 4/2003 Tobey
6,558,200 B1 5/2003 Choy
6,626,685 B2 9/2003 Toda
2005/0122933 A1 5/2005 Hamner

* cited by examiner

*Primary Examiner*—James R. Harvey

(57) ABSTRACT

A fully buffered memory module is disclosed having a two piece housing comprised of a primary housing portion and an alignment plate. An array of terminals is included having at least two terminal configurations where the terminals are trapped between the primary housing portion and the alignment plate. A printed circuit board tine of the electrical terminals extend through the alignment plate while a contact portion protrudes into a slot which receives the memory module.

8 Claims, 12 Drawing Sheets

FULLY BUFFERED PRESS-FIT DIMM CONNECTOR

BACKGROUND OF THE INVENTION

The present invention relates to DIMM memory connector which cooperates with fully buffered requirements.

Card Connectors that connect a daughterboard such as a DIMM, to a motherboard have long been used in electronic devices such as personal computers. Such connectors typically include a connector housing having opposed contacts for interconnection to the DIMM module, are interconnected to the motherboard via contact tines, and have a latching mechanism which latches the DIMM to the card connector. However as the electronic speed continues to increase, so too, must the card connectors increase their performance.

Such is the case with the fully buffered requirements which requires a minimization of both contact skew as well as far/near end crosstalk.

As far as the contact skew is concerned, this requirement calls for a minimization of signal path difference in the contact system, and therefore requires substantially similar contact path lengths in the opposed contacts referred to above. With respect to the minimization of crosstalk, this requirement results in a contact configuration having no dead end stubs for contact rigidification, as is present in other DIMM designs. Such an example is shown in our U.S. Patent publication number U.S. 2005/0112933.

It is therefore an object to overcome these known shortcomings.

SUMMARY OF THE INVENTION

The objects have been accomplished by providing an electrical connector for a memory module, comprising a primary housing portion having a module receiving slot therein, with terminals opposing the slot for interconnection with a module. An alignment plate retains the terminals in place. The terminals comprise a printed circuit board contact extending downwardly from one end of an intermediate base portion, and an upper contact extending upwardly from the opposite end of the base portion. The base portions of the terminals are trapped between a lower face of the primary housing portion and an upper face of the alignment plate.

The upper contact may be defined by a flat blade portion with a contact portion extending from the flat blade portion. The contact portion may be defined by a central portion struck from the flat blade portion and extending outwardly from the flat blade portion and into the module receiving slot. The contact portion may be narrower than the base portion. The primary housing portion may include terminal receiving slots extending upwardly through a lower face. The terminal receiving slots may include rib-like walls adjacent to the module receiving slot, which form openings through which the contact portions extend. The rib-like walls may extend downwardly, and trap at least some of the terminal base portions between the alignment plate and the primary housing portion.

The lateral positions of the printed circuit board contacts may be staggered at longitudinal positions of the contacts. The primary housing portion may be elongate having the module receiving slot extending though an upper face of the housing, and extending longitudinally there along, and the housing further comprising first and second sidewalls extending along the length of the primary housing portion. At least some of the terminals may have the printed circuit board contact adjacent the first sidewall, with the base portion extending towards the module receiving slot, with the upper contacts extending upwardly adjacent to the module receiving slot; and some of the terminals have the printed circuit board contact adjacent the module receiving slot, with the base portions extending towards the second sidewall, with the upper contacts extending upwardly and redirected to a position adjacent to the module receiving slot.

At least some of the terminals may also have the printed circuit board contacts adjacent the second sidewall, with the base portions extending towards the module receiving slot, with the upper contacts extending upwardly adjacent to the module receiving slot; and some of the terminals may have the printed circuit board contact adjacent the module receiving slot, with the base portion extending towards the first sidewall, and with the upper contacts extending upwardly and redirected to a position adjacent to the module receiving slot.

The signal length of all of the terminals may be substantially equal in length.

In another embodiment of the invention, a electrical connector for a memory module, comprises an elongate primary housing portion having a module receiving slot extending though an upper face of the housing, and extending longitudinally there along. The housing further comprises first and second sidewalls extending along the length of the primary housing portion. An array of electrical terminals oppose the slot for interconnection with a memory module. An alignment plate retains the terminals in place. The array of electrical terminals generally comprise individual terminals with each comprising a printed circuit board contact extending downwardly from one end of an intermediate base portion, and an upper contact extending upwardly from the opposite end of the base portion, and the base portions of the terminals being trapped between a lower face of the primary housing portion and an upper face of the alignment plate. The array of electrical terminals comprises a first subset of terminals having first printed circuit board contacts adjacent the first sidewall, with first base portions extending towards the module receiving slot, and with the first upper contacts extending upwardly adjacent to the module receiving slot. A second subset of terminals has second printed circuit board contacts adjacent the module receiving slot, with second base portions extending towards the second sidewall, and with second upper contacts extending upwardly and redirected to a position adjacent to the module receiving slot.

The array of terminals may also include a third subset of terminals having third printed circuit board contacts adjacent the second sidewall, with the third base portions extending towards the module receiving slot, with third upper contacts extending upwardly adjacent to the module receiving slot; and a fourth subset of electrical terminals having fourth printed circuit board contacts adjacent the module receiving slot, with fourth base portions extending towards the first sidewall, and with fourth upper contacts extending upwardly and redirected to a position adjacent to the module receiving slot.

The primary housing portion may include terminal receiving slots extending upwardly through a lower face. The terminal receiving slots include rib-like walls adjacent to the module receiving slot, which form openings through which the contact portions extend. The rib-like walls may extend downwardly, to form a shoulder which traps at least some of the terminal base portions between the alignment plate and the primary housing portion. The shoulder may trap the second and fourth base portions. The contact portions may be defined by a central portion struck from the flat blade portion and extending outwardly from the flat blade portion and into the module receiving slot. The contact portion may be narrower than the base portion.

DETAILED DESCRIPTION OF THE PREFERRED EMBODIMENT

Figure 1:
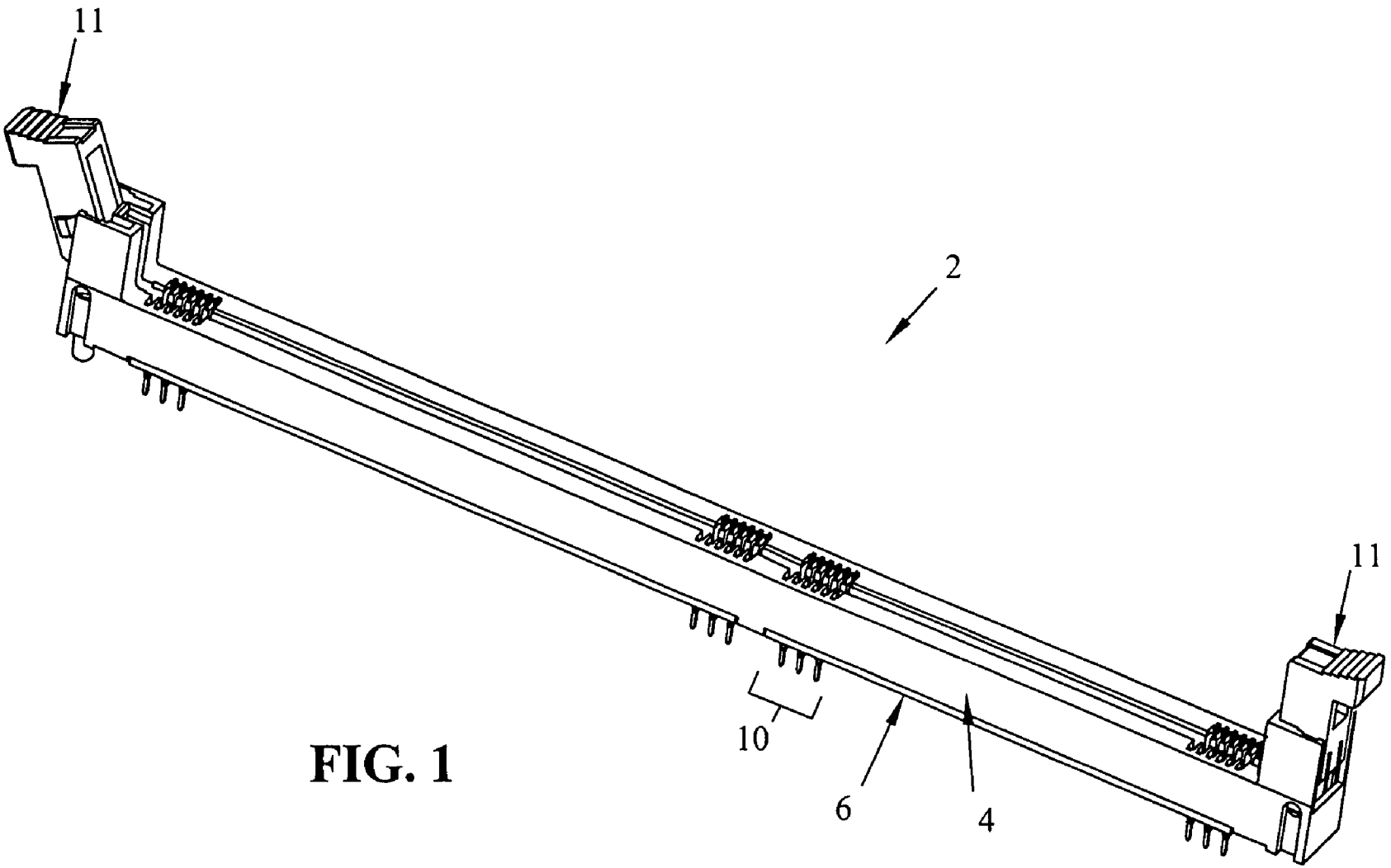
FIG. 1 is a perspective view of the memory module connector of the present invention.

With reference first to FIG. 1, the overall connector assembly is shown generally at 2, and includes a two piece housing comprised of a primary housing portion 4 and an alignment plate 6. The combination of the primary housing portion 4 and alignment plate 6 retains an array of electric terminals 10 therein. The connector assembly 2 further comprises latch members 11 at opposite ends to retain and extract a DIMM module (not shown).

Figure 2:
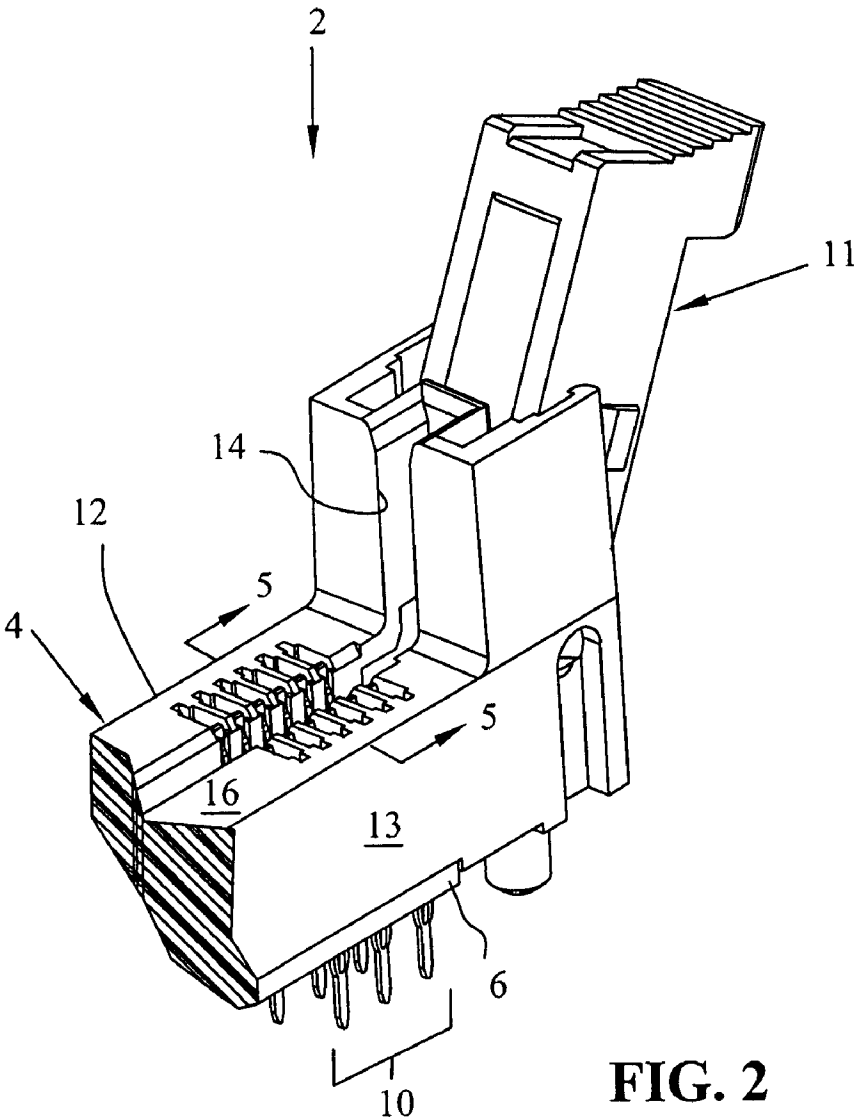
FIG. 2 is a partial end view of the connectors shown in FIG. 1.
Figure 3:
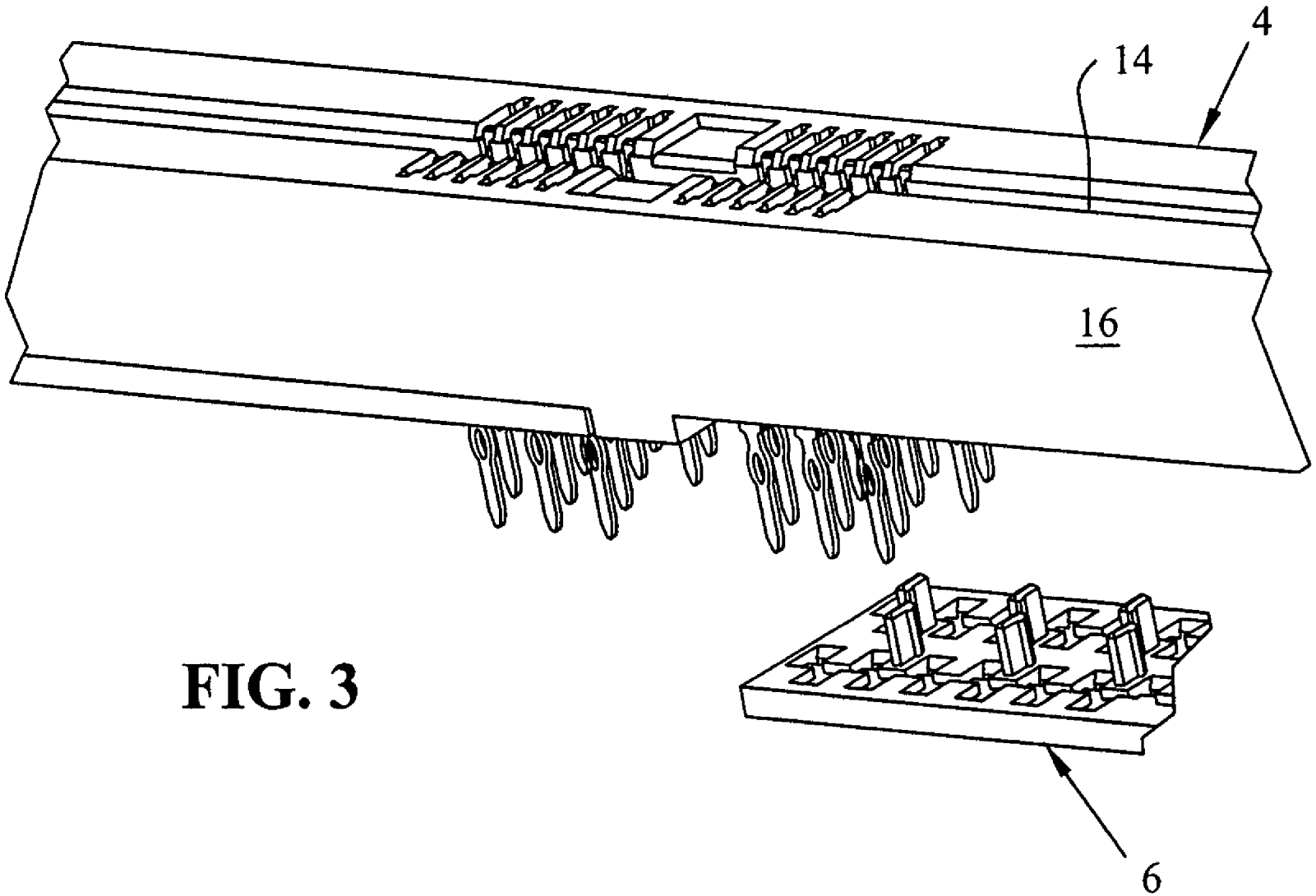
FIG. 3 shows a portion of the connector of FIG. 1 with the alignment plate exploded away from the memory connector housing.
Figure 5:
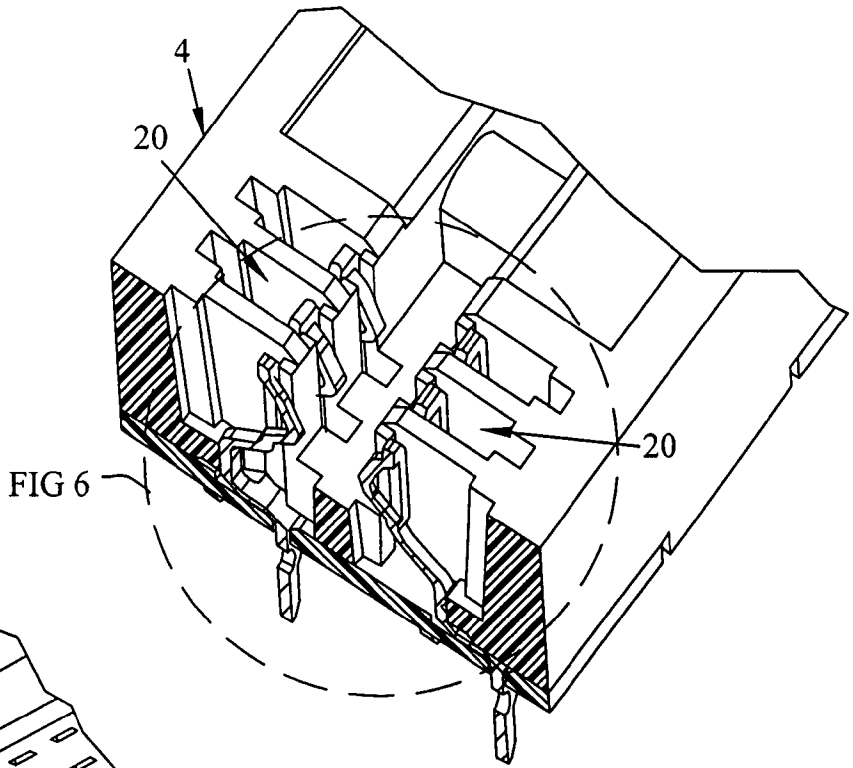
FIG. 5 shows a cross sectional view through lines 5—5 of FIG. 2.
Figure 4:
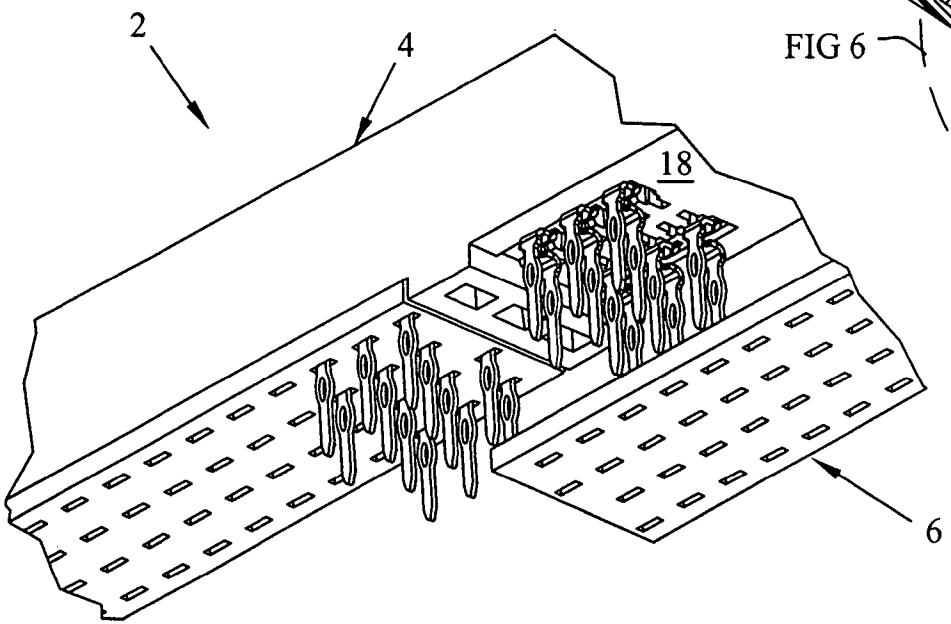
FIG. 4 shows the underside perspective of the connector housing as shown in FIG. 3.
Figure 6:
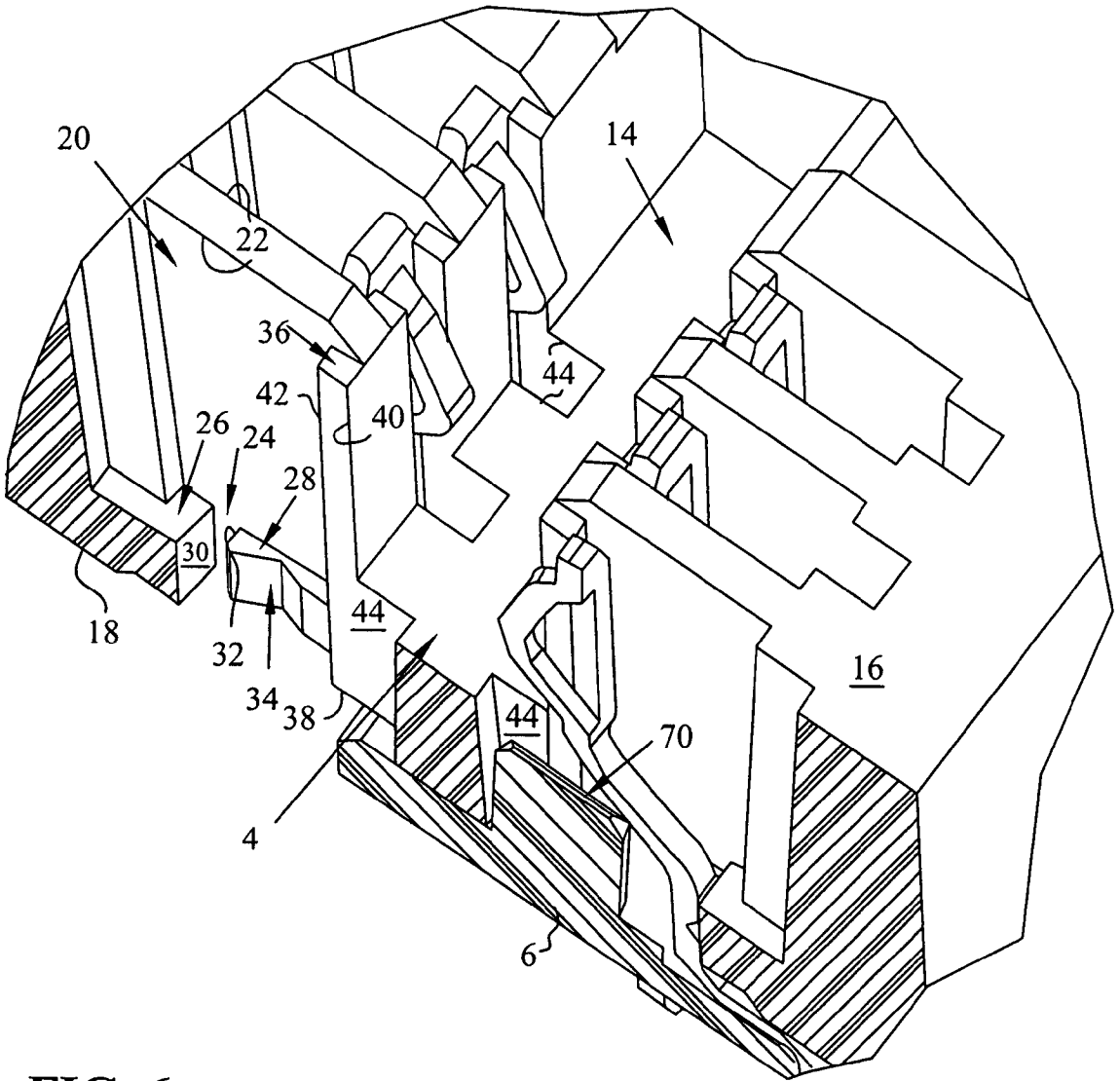
FIG. 6 shows an enlarged perspective view of the area denoted in FIG. 5.

With respect now to FIGS. 2 through 4, it should be noted that primary housing portion 4 is generally elongate, having first and second sidewalls 12, 13 and further includes a module receiving slot 14 therein. The slot 14 extends into an upper face 16 of housing portion 4. It should also be noted from FIGS. 3 and 4, that alignment plate 6 is removable from a lower face 18 of housing portion 4. With reference now to FIGS. 5 and 6, primary housing portion 4 will be described in greater detail.

As best shown in FIG. 5, housing portion 4 includes a plurality of terminal receiving slots 20 extending from lower face 18 to upper face 16. As shown in FIG. 6, slots 20 generally include opposing faces 22 which form the side walls for terminal slots 20. Terminal receiving openings 24 are formed between continuous wall 26 and contoured walls 28 where walls 28 are integrally formed on opposing faces 22. Continuous wall 26 is formed with an end face 30 which opposes the end face 32 of contoured wall 28. Contoured wall 28 further includes a relief area 34 to allow passage of a terminal into the slots upon insertion thereof.

Housing portion 4 further includes an elongate rib-like wall 36 which extends from a position adjacent upper face 16 to a position coplanar with lower face 18 to form a clamping surface 38. Rib-like wall 36 further includes a sidewall portion 40 and a rearwardly facing wall portion 42. Finally, rib-like wall 36 includes interference wall portion 44 as will also be described herein in greater detail.

Figure 7:
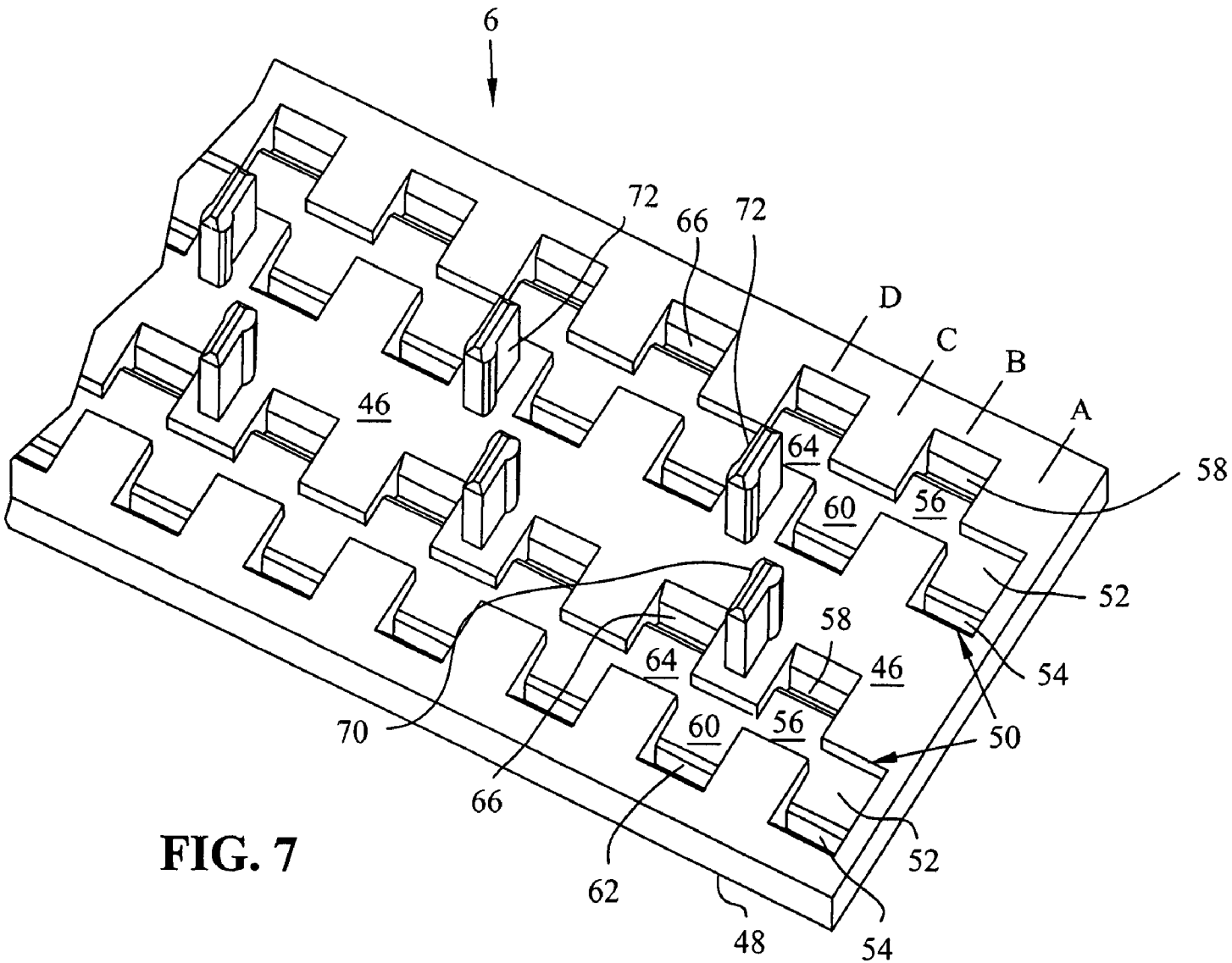
FIG. 7 shows an enlarged view of a portion of the alignment plate.

With respect now to FIG. 7, alignment plate 6 is shown having an inner face 46 and an outer face 48. Two elongate side by side contoured wells 50 are formed on the inner face 46 for aligning and retaining the array of terminals 10 as shown herein. It should also be appreciated that the contoured walls form a repeating pattern and in the embodiment shown in FIG. 7, has a repeating pattern of four configurations that is, positions A–D. It should be understood that neither the repeating pattern, nor the number of configurations, is necessary to carry out the invention.

For example, at longitudinal position A, the alignment plate 6 includes surfaces 52 which lead into openings 54, where the openings 54 are on the near side of the surfaces 52 as shown in FIG. 7. At longitudinal position B, the alignment plate 6 includes surfaces 56 leading into openings 58 on the far side of surfaces 56 as viewed in FIG. 7. At longitudinal position C, surfaces 60 are similar to surfaces 52 and further include an opening 62 similar to opening 54, however longitudinal position C includes a retaining post 70 in combination therewith. Finally at longitudinal position D, the alignment plate includes surfaces 64 in combination with openings 66, and further in combination with retaining post 72.

As mentioned above, connector assembly 2 includes an array of electrical terminals 10. The array of electric terminals is comprised of individual terminals 80, 100 as shown in FIGS. 8 and 9 and as more particularly described below.

Figure 9:
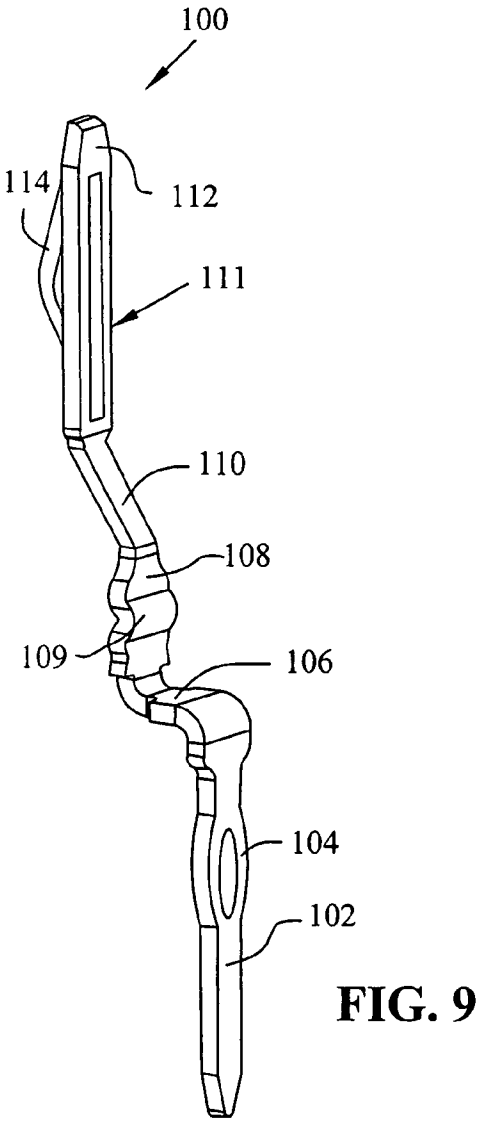
FIG. 9 shows a perspective view of the corresponding opposed terminal.
Figure 8:
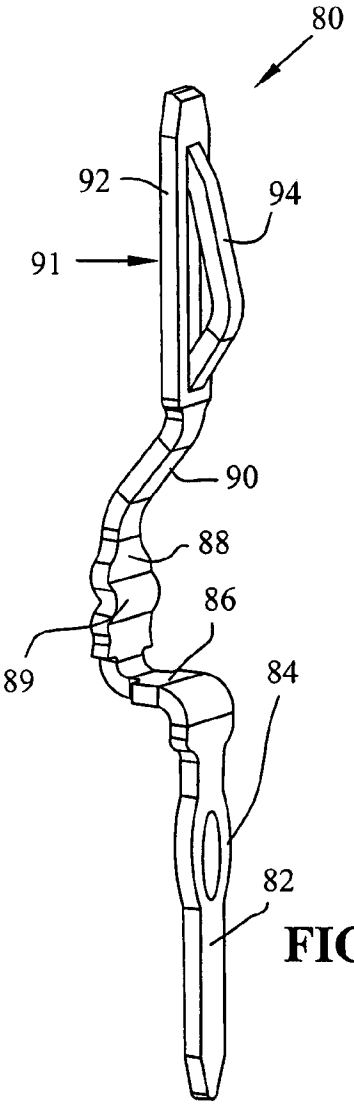
FIG. 8 shows a perspective view of one of the opposed contact portions.

As shown in FIGS. 8 and 9, terminals 80, 100 include printed circuit board tine portions 82, 102 where each tine portion includes a printed circuit board contact 84, 104. As shown in the embodiments of FIGS. 8 and 9 the contacts 84, 104 are shown as "eye of the needle" type press fit contacts. Terminals 80, 100 further include a flattened base portion 86, 106; a transition portion 88, 108; retention portions 89, 109 and an inwardly directed portion 90, 110 (inwardly in relation to the module receiving slot). Upper contacts 91, 111 comprise flat blade portions 92, 112 which extend upwardly from the corresponding transition portions 90, 110 to define the upper contacts with inwardly directed contact portions at 94, 114. As shown, contact portions 94, 114 are defined by central portions stamped from the blade portions 92, 112. It should also be understood that the terminals 80, 100, even though differently configured, have substantially equal lengths, from the standpoint of their respective signal path lengths.

With respect now to FIGS. 10 to 13, the cooperation of the primary housing portion 4, alignment plate 6 and terminals 80, 100 will be described in greater detail.

Figure 10:
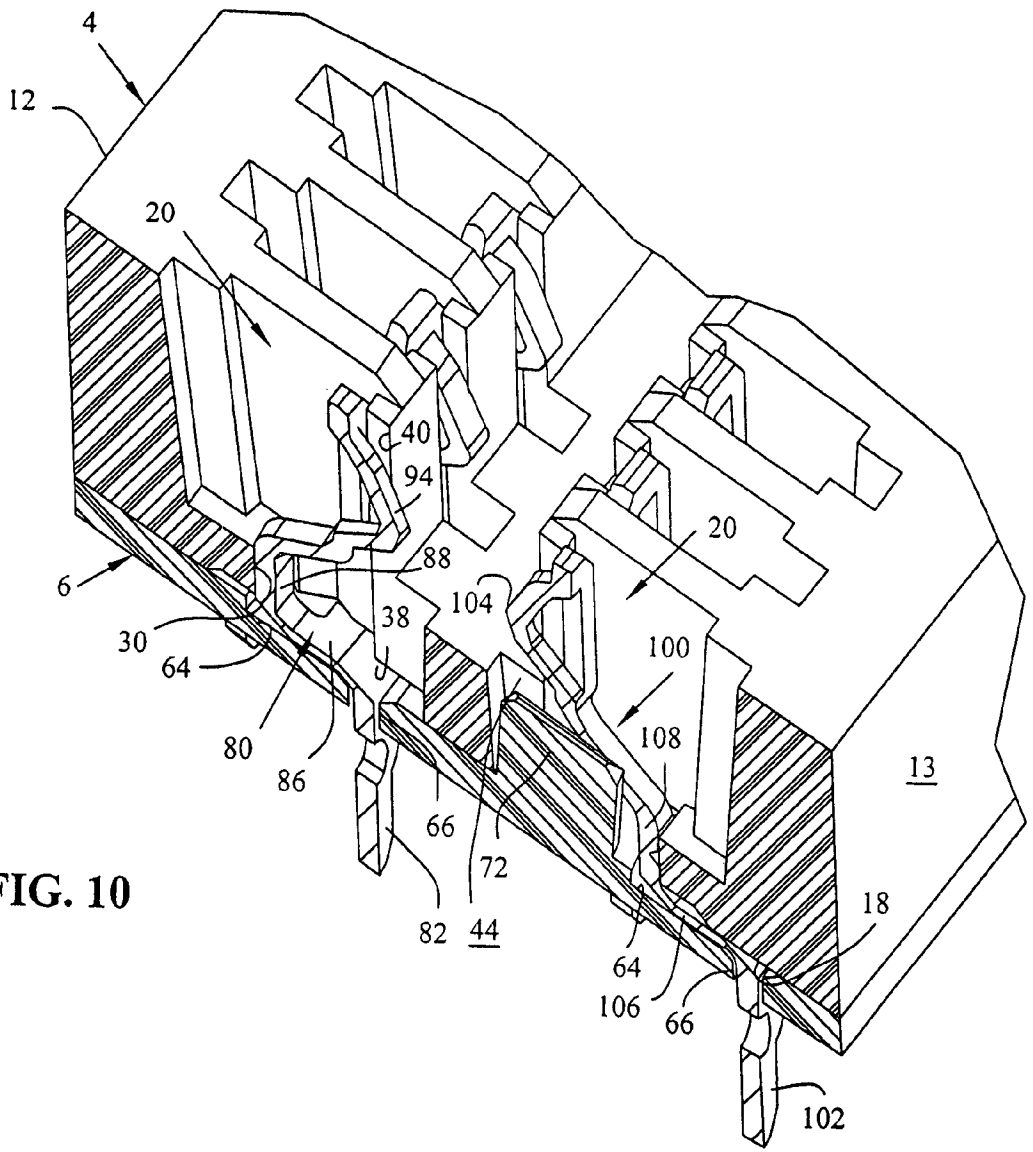
FIG. 10 is similar to FIG. 6 showing the terminals and their respective positions.

With respect first to FIG. 10, two terminals 80, 100 are shown trapped between alignment plate 6 and housing portion 4. This position corresponds with longitudinal position D shown in FIG. 7 (assuming a cross section is taken with a view looking to the left in FIG. 7). In particular, terminal 80 is shown with the flattened base portion 86 positioned against surface 64 and trapped beneath clamping surface 38. Meanwhile tine portion 82 extends through opening 66 of alignment plate 6 and contact portion 94 protrudes between sidewall portions 40. It should be noted from FIG. 10, that the contact portion 94 is narrower than the base portion 86. This allows the terminal 80 to be slidably received in the slot 20, while at the same time, allows clamping surface 38 to abut the base portion 86. Finally, it should be appreciated that retention portion 88 is press fit between end faces 30, 32.

On the opposite side of the connector, terminal 100 is positioned with its flattened base portion 106 being positioned between surface 64 and lower face 18 of primary housing portion 4. Retaining post 72 is also shown trapped in the terminal receiving slot 20 between interference walls 44. It should be noted that the retention of the terminal 100 is slightly different. As base portion 106 extends towards side wall 13, away from contact portion 104, base portion 106 is simply retained between lower face 18 and surface 64.

Figure 11:
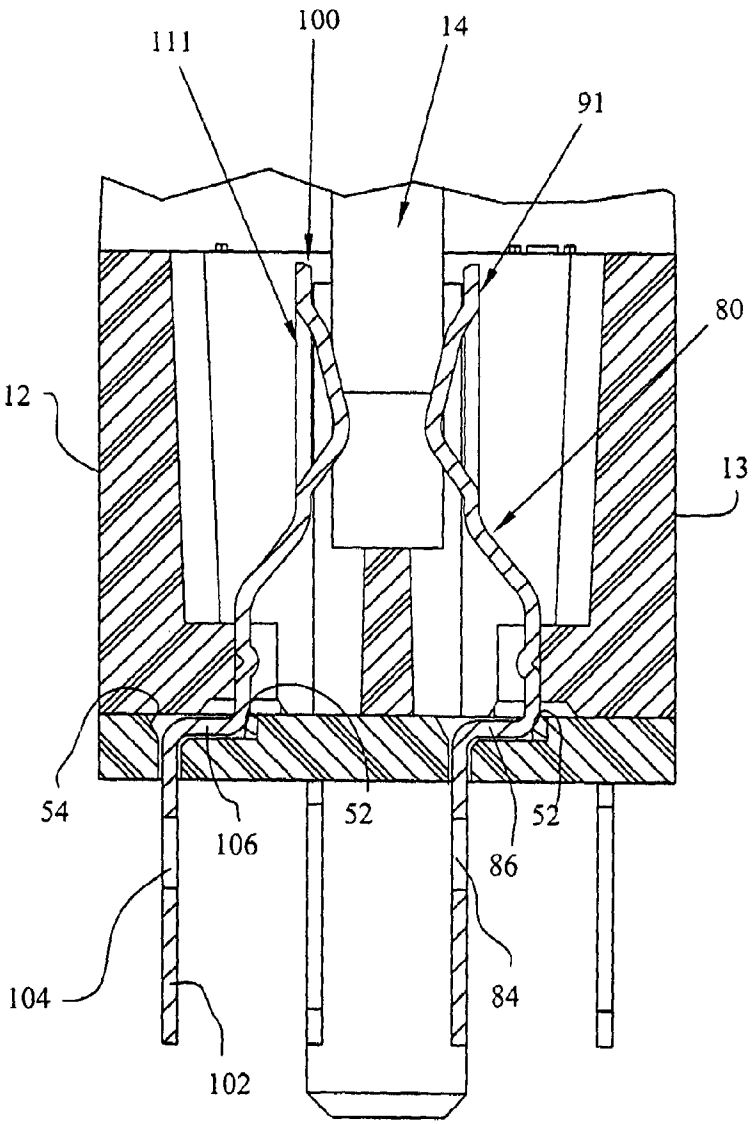
FIGS. 11–14 are cross sectional views taken along various longitudinal positions to show the cooperation of the electrical terminals in multiple assembled configurations, together with the cooperation of the alignment plate.

In a like manner, FIG. 11 shows a cross sectional view through the combination of the primary housing portion, terminals 80, 100, and alignment plate 6, at a position corresponding to longitudinal position A (again assuming a cross section is taken with a view looking to the left in FIG. 7). This cross-section shows terminals 80, 100 trapped against corresponding surfaces 52 as described above in FIG. 10. FIG. 11 also shows a first of four subsets of terminal configurations. As shown, a first subset includes a printed circuit board contact portion 104 being positioned adjacent to first side wall 12, with base portion 106 extending towards module receiving slot 14. Upper contact 111 extends from the opposite end of base portion 106, from contact portion 104, and extends upwardly and is redirected towards the module receiving slot 14. FIG. 11 also shows a second subset of terminal configuration where printed circuit board contact 84 is adjacent to the module receiving slot 14, and base portion 86 extends towards second sidewall 13. Upper contact 91 extends from base portion 86, and is redirected to a position adjacent the module receiving slot 14.

Figure 12:
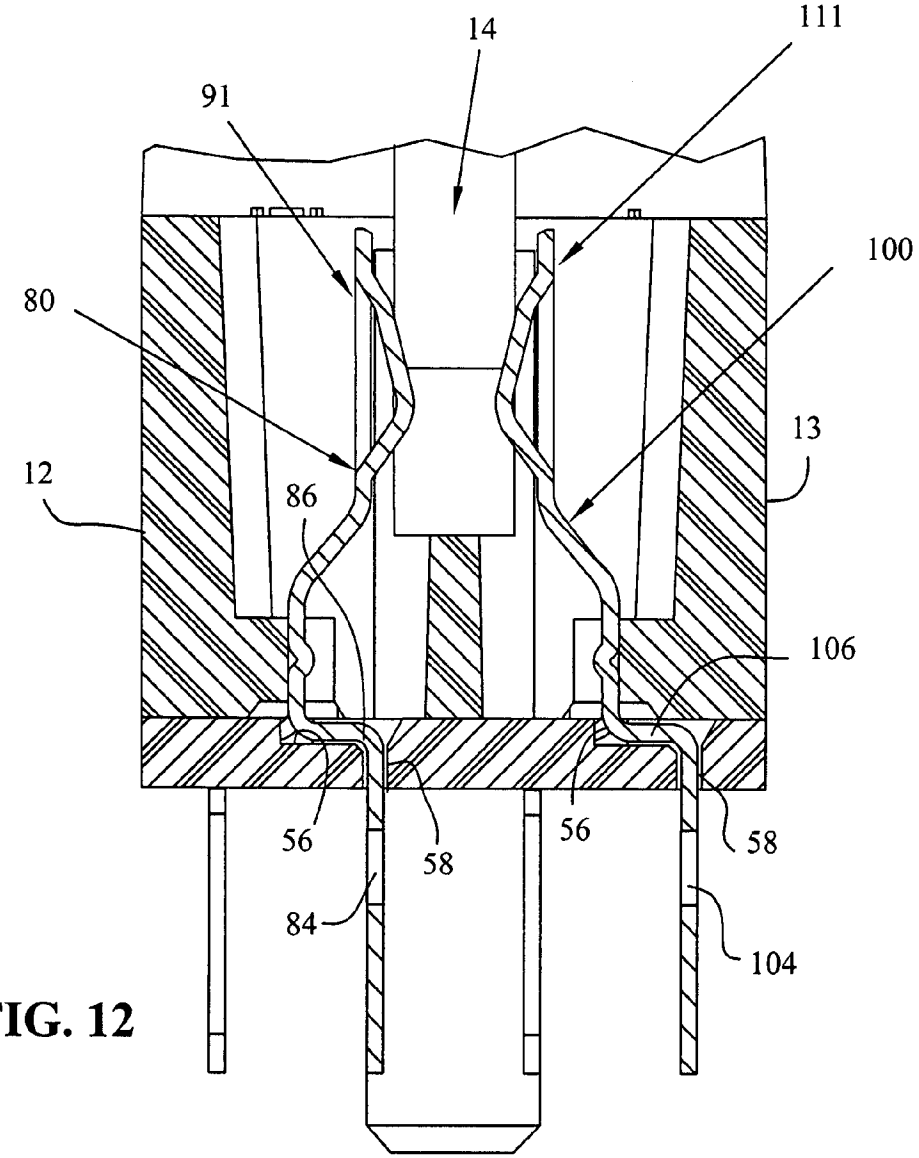

FIG. 12 shows a cross sectional view similar to that of FIG. 11, at a position corresponding to longitudinal position B (assuming a cross section is taken with a view looking to the left in FIG. 7) with the terminals 80, 100 trapped against corresponding surfaces 56. FIG. 12 also shows a third of four subsets of terminal configurations. In this subset, printed circuit board contacts 104 are adjacent to second sidewall 13, and base portion 106 extends towards the module receiving slot 14. Upper contact 111 is thereafter redirected to a position adjacent module receiving slot 14.

Finally, FIG. 12 also shows the fourth subset of terminal configurations and in this configuration, contact 84 is adjacent module receiving slot 14 and base portion 86 extends towards first sidewall 12. Upper contact 91 is thereafter redirected to a position adjacent module receiving slot 14.

Figure 13:
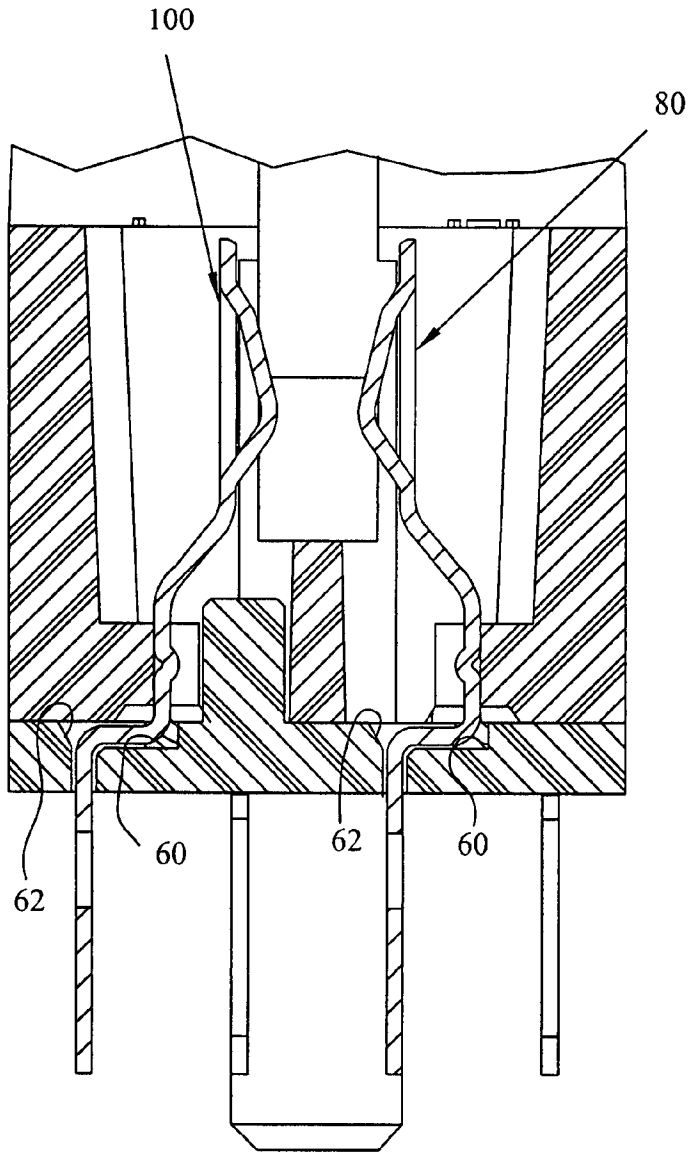
Figure 14:
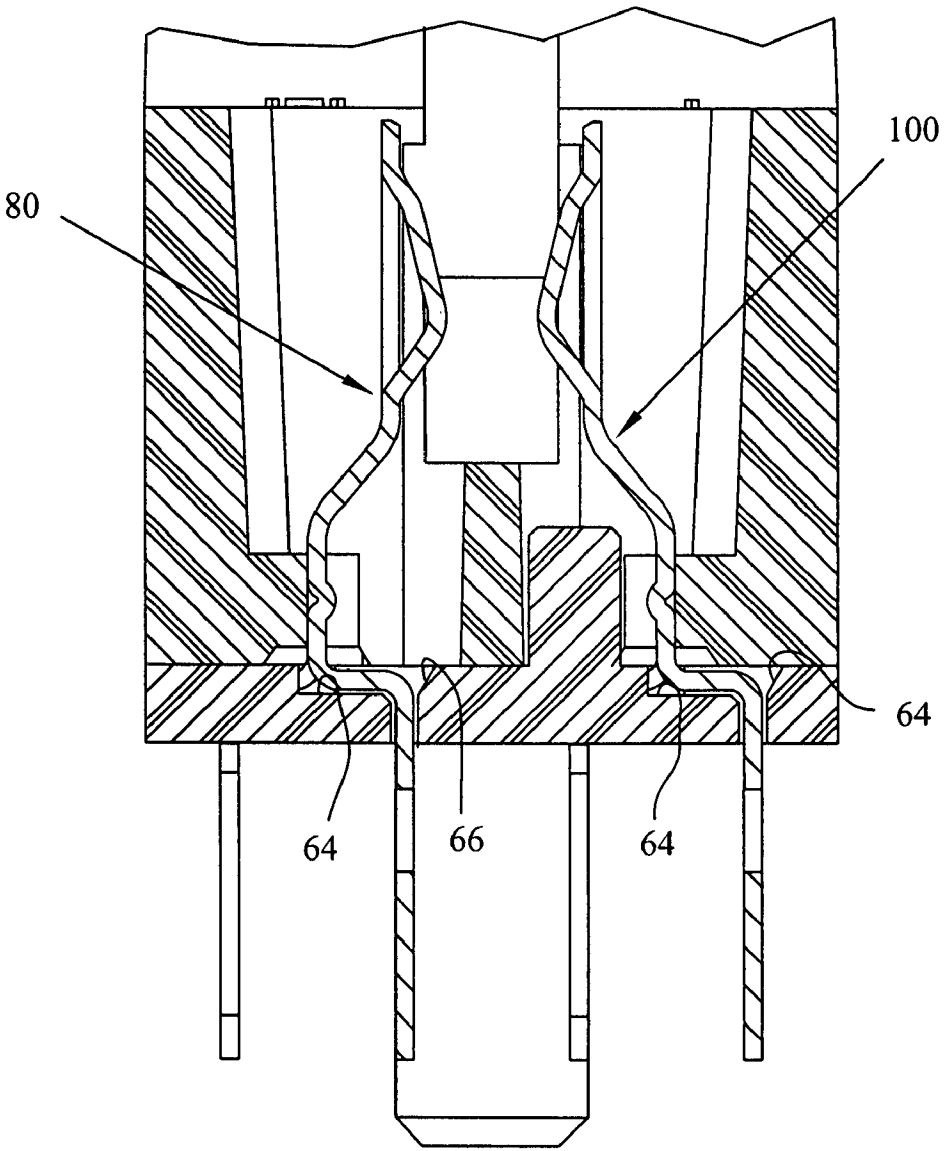

FIG. 13 shows a cross sectional view similar to that of FIG. 11, at a position corresponding to longitudinal position C of FIG. 7, (assuming a cross section is taken with a view looking to the left in FIG. 7) with terminals 80, 100 trapped against the corresponding surfaces 60. Finally, FIG. 14 shows a cross sectional view similar to that of FIG. 11, at a position corresponding to longitudinal position D of FIG. 7, (assuming a cross section is taken with a view looking to the left in FIG. 7) showing terminals 80 and 100 trapped against corresponding surface 64, as was described above with respect to FIG. 10.

It should be appreciated from the above description that when terminal 100 is used, a flattened portion 106 is trapped between the lower face of the primary housing portion 4 lower face 18 and its corresponding alignment plate surface 52, 56, 60 and 64; and when terminal 80 is used it is trapped beneath clamping surface 38 and its corresponding surface 52, 56, 60 and 64. It should also be appreciated that this configuration allows the terminals 80, 100 to be assembled from the lower face 18 of the primary housing portion 4, that the terminals are held in place by a combination of their retention portions 89, 109 in combination with the end faces 30, 32; and in further combination with the alignment plate 6. Furthermore, it should be understood that the contacts are press-fit contacts and that the terminals have positive back stops in the housing, that is surfaces 18, 38, for rigidification of the terminals 80, 100, when the connector assembly 2 is press fit into a board.

With respect to the electrical characteristics, it should be appreciated from FIGS. 8 and 9 that the terminals 80, 100, while slightly different in configuration, have an overall signal length substantially identical in length. Moreover, as viewed in FIGS. 8 and 9, the terminals 80, 100 do not include any stubbed portions, or discontinuous portions which could effect the cross talk characteristics. Thus, the present connector meets the fully buffered requirements.

The invention claimed is:

1. A fully buffered electrical connector for a memory module, comprising:

an elongate primary housing having a module receiving slot extending through an upper face of said housing, and extending longitudinally along a length of said housing, and said housing further comprising first and second sidewalls extending along the length of said housing;

an array of electrical terminals opposing said slot for interconnection with a memory module; and an alignment plate to retain the terminals in place;

said array of electrical terminals generally comprising individual terminals with each comprising a printed circuit board contact extending downwardly from one end of an intermediate base portion, and an upper contact extending upwardly from the opposite end of said base portion, and the base portions of the terminals extending only between said upper and printed circuit board contacts, and said base portions being trapped between a lower face of said housing and an upper face of said alignment plate, said array of electrical terminals comprising a first subset of terminals having first printed circuit board contacts adjacent said first sidewall, with first base portions extending towards said module receiving slot, and with first upper contacts extending upwardly adjacent to said module receiving slot; and a second subset of terminals having second printed circuit board contacts adjacent the module receiving slot, with second base portions extending towards said second sidewall, with second upper contacts extending upwardly and redirected to a position adjacent to said module receiving slot.

2. The electrical connector of claim 1, wherein said array of terminals includes a third subset of terminals having third printed circuit board contacts adjacent said second sidewall, with third base portions extending towards the module receiving slot, with third upper contacts extending upwardly adjacent to said module receiving slot; and a fourth subset of electrical terminals having fourth printed circuit board contacts adjacent the module receiving slot, with fourth base portions extending towards said first sidewall, and with fourth upper contacts extending upwardly and redirected to a position adjacent to said module receiving slot.

3. The electrical connector of claim 2, wherein said housing includes terminal receiving slots extending upwardly through said lower face.

4. The electrical connector of claim 3, wherein said terminal receiving slots include rib-like walls adjacent to said module receiving slot, which form openings through which said upper contacts extend.

5. The electrical connector of claim 4, wherein said rib-like walls extend downwardly to form a shoulder which traps at least some of said terminal base portions between said alignment plate and said housing.

6. The electrical connector of claim 5, wherein said shoulder traps said second and fourth base portions.

7. The electrical connector of claim 5, wherein each of the upper contacts is defined by a central portion struck from a flat blade portion and extending outwardly from said flat blade portion and into said module receiving slot.

8. The electrical connector of claim 7, wherein each said upper contact is narrower than its respective said base portion.

* * * * *